United States Patent [19]

Petersen

[11] 4,041,569

[45] Aug. 16, 1977

[54] SEPARATOR SYSTEM

[76] Inventor: Arne G. Petersen, Oak St., R.R. 26-D, Uxbridge, Mass. 01569

[21] Appl. No.: 722,410

[22] Filed: Sept. 13, 1976

[51] Int. Cl.[2] ..... A47L 9/10

[52] U.S. Cl. ..... 15/353; 15/375; 55/216; 55/310; 55/462; 55/467

[58] Field of Search ..... 210/242, DIG. 25; 55/417, 467, 498, 216, 310, 462; 15/353, 302, 320

[56] References Cited

U.S. PATENT DOCUMENTS

| | | | |
|---|---|---|---|
| 2,549,181 | 4/1951 | Durham | 15/353 X |
| 2,867,231 | 1/1959 | Gerstmann | 15/353 UX |
| 3,180,071 | 4/1965 | Nolte | 15/353 |
| 3,490,208 | 1/1970 | Meyer et al. | 15/353 X |
| 3,618,297 | 7/1969 | Hamrick | 15/353 |
| 3,666,098 | 5/1972 | Garland et a. | 210/DIG. 25 |
| 3,727,766 | 4/1973 | Horne et al. | 210/242 |
| 3,760,944 | 9/1973 | Bell et al. | 210/DIG. 25 |
| 3,775,951 | 12/1975 | Eicholz et al. | 15/353 |
| 3,870,486 | 3/1975 | Eriksson et al. | 55/467 |
| 3,877,902 | 4/1975 | Eriksson et al. | 55/467 |
| 3,909,416 | 9/1975 | Int'Veld | 210/DIG. 25 |
| 3,921,250 | 11/1975 | Jerabek | 15/353 |

*Primary Examiner*—Theodore A. Granger
*Attorney, Agent, or Firm*—Norman S. Blodgett; Gerry A. Blodgett

[57] ABSTRACT

A separator system for use in removing liquid from a surface, which surface may be liquid or solid. The system consists of a pickup head, a separator, and an exhaust source which draws air through the pickup head and separator. The pickup head causes liquid to be entrained in the flow of air passing through it. The air and entrained liquid pass to the outer chamber of the separator where the liquid falls out and the air is fed through the inner chamber of the separator to the exhaust source.

11 Claims, 6 Drawing Figures

FIG. 2
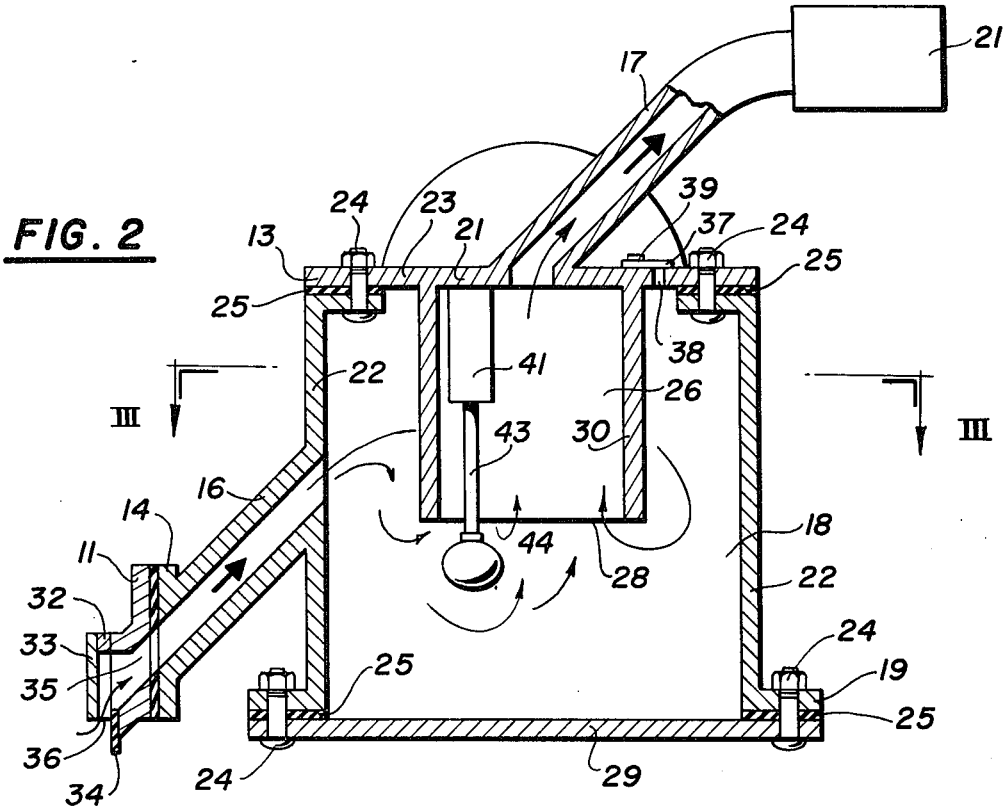
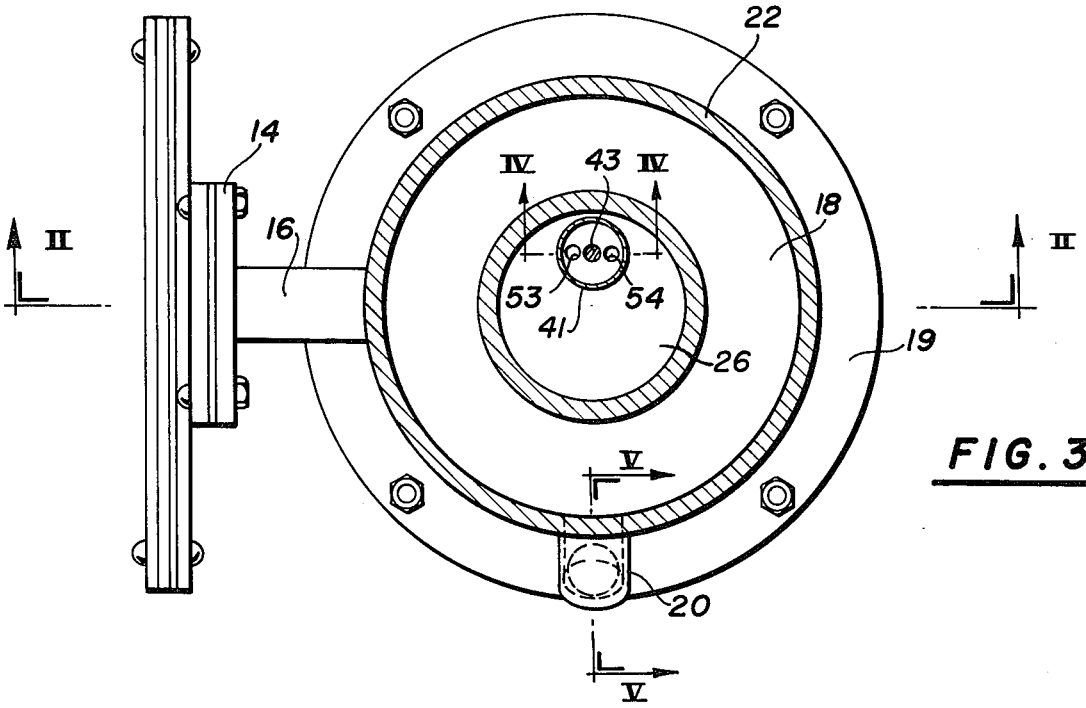
FIG. 3

SEPARATOR SYSTEM

BACKGROUND OF THE INVENTION

The need to remove liquids from horizontal surfaces occurs in many varied contexts. Perhaps the most common is the drying of a floor which has become accidentally or intentionally wet due to washing or spilling. Often the age-old solution of simply waiting until the liquid dries is not practical, either due to the necessity of subsequent operation scheduling or safety. Numerous devices for picking up liquid from floors have been commercialized. They normally involve a vacuum system which causes a stream of incoming air to entrain the liquid on the floor, and a separating system for removing the liquid from the air stream before it reaches the vacuum source. Removing entrained liquid from a gas stream can be an extremely difficult operation particularly when the separation must be extremely complete to avoid deterioration of the vacuum source components. As a result, most devices which are designed to pick up the liquid from the floors involve complicated and expensive systems of tortuous paths, baffles and filters. These complex arrangements which appear necessary to provide the degree of separation required, result in a structure which is not only difficult and expensive to manufacture, but also difficult to use and maintain in a clean and sanitary condition.

In a different context, it is often necessary to remove a layer of liquid from the surface of another layer of liquid. A most dramatic example of this sort of problem is the spillage of oil on the surface of a body of water. Most of the solutions to the cleaning up of this spilled oil involve some sort of chemical destruction of the oil. This type of approach can be both extremely expensive, wasteful, and potentially capable of causing as many environmental difficulties as it cures. These and other difficulties experienced with the prior art devices and methods have been obviated in a novel manner by the present invention.

It is, therefore, an outstanding object of the invention to provide a device for effectively picking up liquid from a surface, where the surface is either solid or liquid.

Another object of this invention is the provision of a device which effectively separates entrained liquid from a moving gas stream.

A further object of the present invention is the provision of a gas-liquid separator which is simple and inexpensive to manufacture, use, and maintain.

It is another object of the instant invention to provide a gas-liquid separator in which pass-through of liquid to the exhaust source is strictly minimized.

A still further object of the invention is the provision of a gas-liquid separation device which is capable of a wide range of uses including removal of oil slicks from the surface of water.

It is a further object of the invention to provide a gas-liquid separator which is capable of feeding the liquid into a wide range of receptacles including commercial barrels.

With these and other objects in view, as will be apparent to those skilled in the art, the invention resides in the combination of parts set forth in the specification and covered by the claims appended hereto.

SUMMARY OF THE INVENTION

This invention involves a separator for picking up liquid from a surface and adapted to be connected to an exhaust source. This separator system includes an outer chamber, an inlet conduit which enters into the side wall of the outer chamber, and a pick-up head attached to the other end of the inlet conduit. An inner chamber is positioned within the upper portion of the outer chamber and extends downward below the level of the entrance of the inlet conduit. The inner chamber has an open bottom. An outlet conduit enters through the top of the inner chamber, and is connected to an exhaust source.

BRIEF DESCRIPTION OF THE DRAWINGS

The character of the invention, however, may be best understood by reference to one of its structural forms, as illustrated by the accompanying drawings, in which:

FIG. 2 is a sectional view of the separator system taken along line II—II of FIG. 3, FIG. 3 is a plan, sectional view of the separation system taken along line III—III of FIG. 2.

DESCRIPTION OF THE PREFERRED EMBODIMENT

Figure 1:
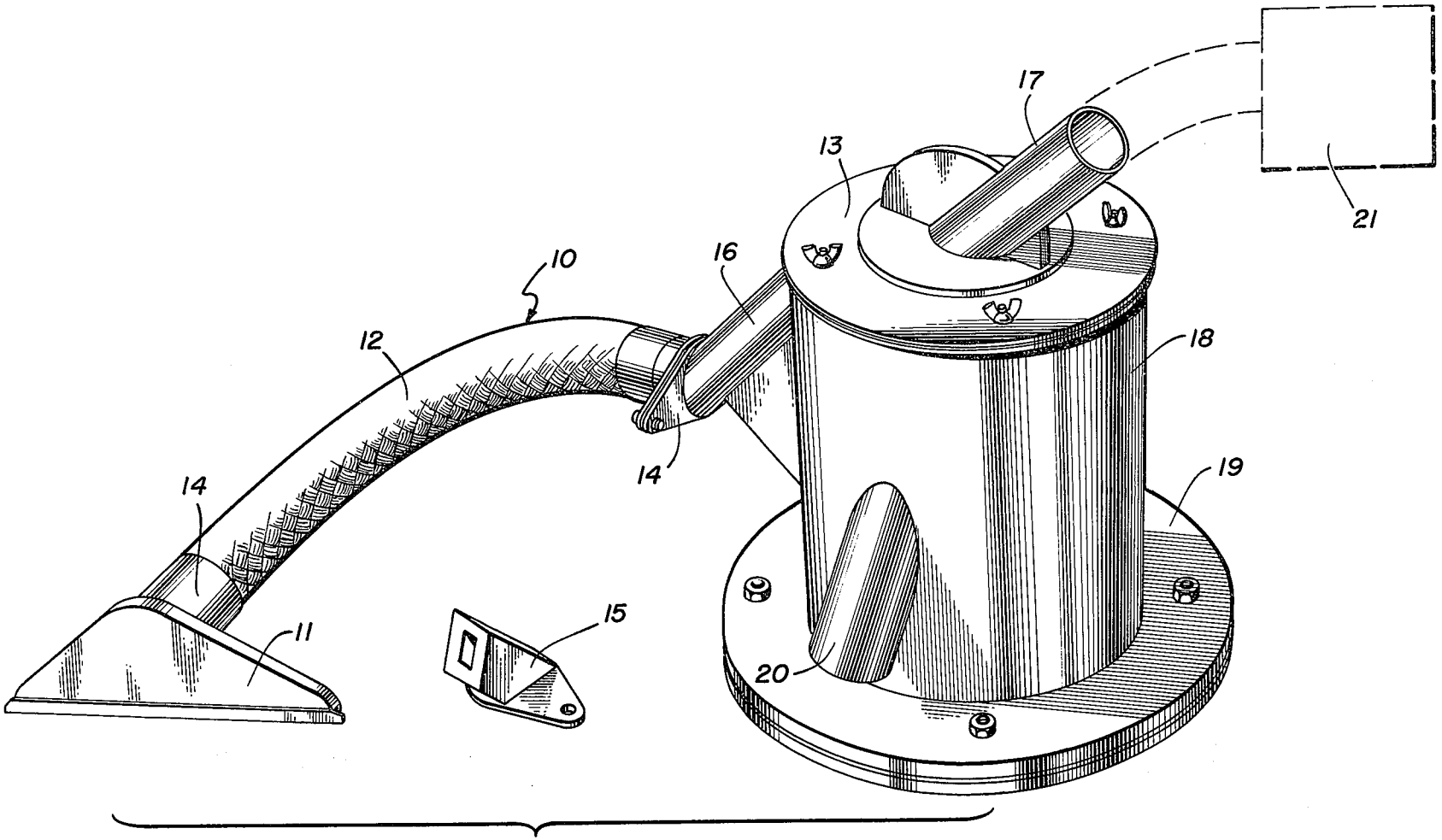
FIG. 1 is a perspective view of a separator system embodying the principles of the present invention.

Referring first to FIG. 1 in which are shown the general features of the present invention, the separation system indicated generally by the numeral 10, is shown to include a pickup head 11, a flexible hose 12, and a separator 13. The pickup head 11, flexible hose 12, and separator 13 are connected together by standard flanged couplings 14 so that the various elements can be connected interchangeably. An alternative pickup head 15 is also shown.

The separator 13 includes a cylindrical inlet conduit 16 and a cylindrical outlet conduit 17. The two conduits are generally coaxial. The separator 13 also includes an outer chamber 18, a base flange 19, and a check nozzle 20. An exhaust source 21 such as a vacuum cleaner or fan is connected to the outlet conduit.

FIG. 2 shows a sectioned elevation view of the separator system shown in FIG. 1, except that the flexible hose 12 has been eliminated and the pickup head 11 has been connected directly to the inlet conduit 16. The outer chamber 18 consists of right circular cylindrical side walls 22 with the base flange 19 at the bottom, a top 23, and a bottom 29, each of which are connected to the side walls by bolts 24 and resilient seals 25. Extending downward from the top 23 of the outer chamber 18 is an inner chamber 26 which consists of a top 27, which is actually part of the top 23 of the outer chamber, a right circular cylindrical side wall 30 which is coaxial with the side wall of the outer chamber is half its diameter and extends downward into the outer chamber about two-thirds of the length of the outer chamber to a level. The inner chamber 26 also has an open bottom 28.

The inlet conduit 16 passes through the side wall 22 of the outer chamber 18 in such a way that the axis of the inlet conduit forms an angle of approximately 45° with the generatrix of the side wall 22, is coplanar with the axis of the side wall 22, and enters the side wall about the level of the bottom 28, of the inner chamber 26. The pickup head 11 is connected to the other end of the inlet conduit 16 by means of flange coupling 14. The pickup head 11 consists of a base 31, a spacer 32, and a front plate 33. The base 31 has a central bore 35 which corresponds to the bore of the inlet conduit 16. Along the lower edge of the base 31 is an elongated resilient blade 34. Access to bore 35 is provided along the forward edge of the blade 34 by spacer 32 holding the front plate 33 a distance away from the base 31. The resulting elongated opening 36 can be adjusted as to the wide dimension between the front plate 33 and the blade 34 by changing the spacer 32.

Coaxial with the inlet conduit 16, but entering the top 27 of the inner chamber 26, is the cylindrical outlet conduit 17. The outside end of the outlet conduit 17 is connected to an exhaust source 21, such as a vacuum cleaner or fan.

In the top of the outer chamber 18 is a controlled leak 37. The controlled leak consists of a bore 38 through the top of the inner chamber and a flapper 39 which is pivotally connected to the top of the outer chamber so that it may provide varying degrees of closure of the bore 38.

Figure 4:
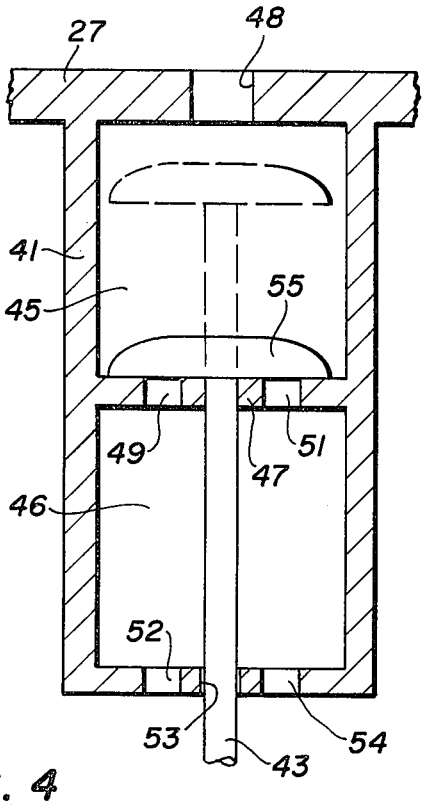
FIG. 4 is a sectional view taken along line IV—IV of FIG. 3.

A vacuum breaker is connected to the top of the inner chamber at an area spaced from the entrance of the output conduit. Extending downwardly from the breaker is a shaft 43 having a float 44 at its end. In a first position the float is suspended at a point below the lowest level of the inner chamber, but the presence of liquid at this level will cause the float to move upward into a second position. FIG. 4 shows a sectional view of the interior of the vacuum breaker body 42. The interior of the body 42 is divided into an upper chamber 45 and a lower chamber 46 by a divider 47. A bore 48 connects the upper chamber 45 with atmosphere. Bores 49, 50, and 51 connect the upper and lower chambers. Bores 52, 53, and 54 connect the lower chamber to the interior of the inner chamber 26. The shaft 43 is connected through bores 53 and 50 to plunger 55. When float 44 is in its first or lowest position, it acts through shaft 43 to cause plunger 55 to close bores 49 and 51. When the float 44 is in its second or highest position, plunger 55 does not interfere with the flow of air through bores 48, 49, 51, 52, and 54.

Figure 5:
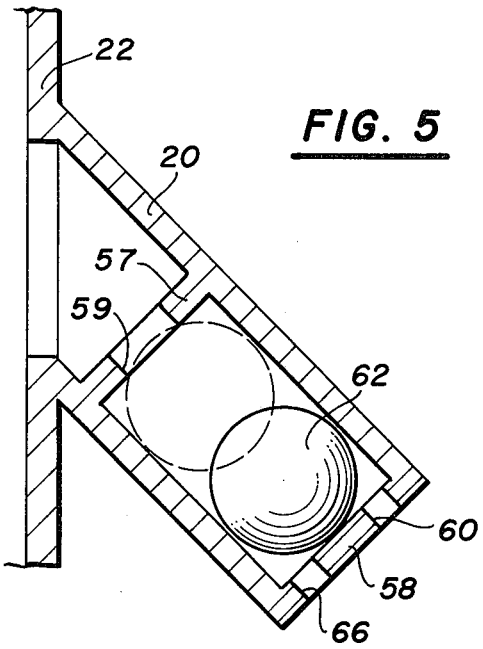
FIG. 5 is a sectional view taken along line V—V of FIG. 3.

Check nozzle 20 penetrates the side wall 22 of the outer chamber at a point slightly below the lowest level of the inner chamber. As shown in cross-section in FIG. 5, the check nozzle 20 is a conduit of square cross-section leading outwardly and downwardly of the side wall 22. Dividers 57 and 58 interrupt the conduit but have bores 59, 60, and 61 to allow the passage of liquid. A sphere 62 is slidably held in the conduit between the dividers 57 and 58. When the sphere is in its first position, it contacts the divider 58, but does not block the bores 61 and 60 because they are non-axial. In its second position, shown as dash lines, the sphere 62 blocks the bore 59 in the divider 57 because the bore 59 is axial.

The operation of the present invention will now be readily understood in view of the above description. Referring to FIG. 2, it can be seen that when the vacuum source 21 is activated, the vacuum source pulls a stream of air through output conduit 17. There is a resulting drop in pressure in the inner chamber 26 and outer chamber 18. At this point the vacuum breaker 41, which is in its first position (shown in solid lines in FIG. 4) because only gravity is effecting the float 44, is tightly sealed against leakage by the effect of the low pressure on the plunger 55 against the divider 47. The low pressure also draws the sphere 62 in the check nozzle 20 upward into the second position (shown in FIG. 5 as dash lines), and seals the check nozzle 20. The controlled leak 37 would normally be completely closed, but would be slightly or completely opened to control the amount of vacuum in the inner and outer chambers so that a wide range of vacuum sources can provide optimum vacuum. Thus, the only source of air to maintain pressure within the inner and outer chambers is drawn through opening 36 in the pickup head 11, upward through the input conduit 16 and into the outer chamber 18, and thence downward around the lower edge of the inner chamber 26. When the resilient blade 34 is placed in contact with a surface on which liquid is collected, intermingling of the liquid and the air stream moving into the opening 36 cause entrainment of the liquid in the air stream. The mixed gas and liquid moves up the input conduit 16 and into the outer chamber 18. At this point, two phenomena change the stream. First, the abrupt change in the effective cross-section of the conduit between the inlet conduit 16 and the outer chamber 18 causes a substantial drop in the velocity of the stream. This substantial drop in velocity causes a substantial decrease in the capacity of the stream to hold entrained liquid. At the same time, the stream is impinging upwardly at approximately a 45° angle with the outer surface of the side wall of the inner chamber 26. The result is a large momentum change from a direction which is upward and radially inward of the outer chamber 18, thence to a direction downward and axial or circumferential within the outer chamber 18, and thence axially upward into the inner chamber 26 through its gas-permeable bottom 28. The result of this drop in velocity and movement through the tortuous path is that nearly all of the entrained liquid drops out of the gas stream and falls to the bottom 29 of the outer chamber 18. With the exception of normal atmospheric moisture, even when the bottom of the inner chamber 26 is completely open, there is essentially no pass-through of liquid to the outlet conduit 17 and vacuum source 21.

When the level of the liquid approaches the lowest level of the inner chamber 26, float 44 of the vacuum breaker 41 is lifted, moving the plunger 55 into its second position (shown as dash lines in FIG. 4) and the vacuum in the inner chamber 26 is released. Air flow through bore 48 would thus indicate that the contents of the outer chamber should be emptied.

When the separator is tipped about the axis passing through the inlet conduit 16 and outlet conduit 17, the liquid in the separator enters the conduit of the check nozzle 20. The presence of the liquid breaks the vacuum within the conduit and causes the sphere 62 to move from its sealing, second position (shown as dash lines in FIG. 5) to its first position (shown in solid lines in FIG. 5). This allows the liquid to pass freely through the check nozzle 20 and out of the outer chamber.

Figure 6:
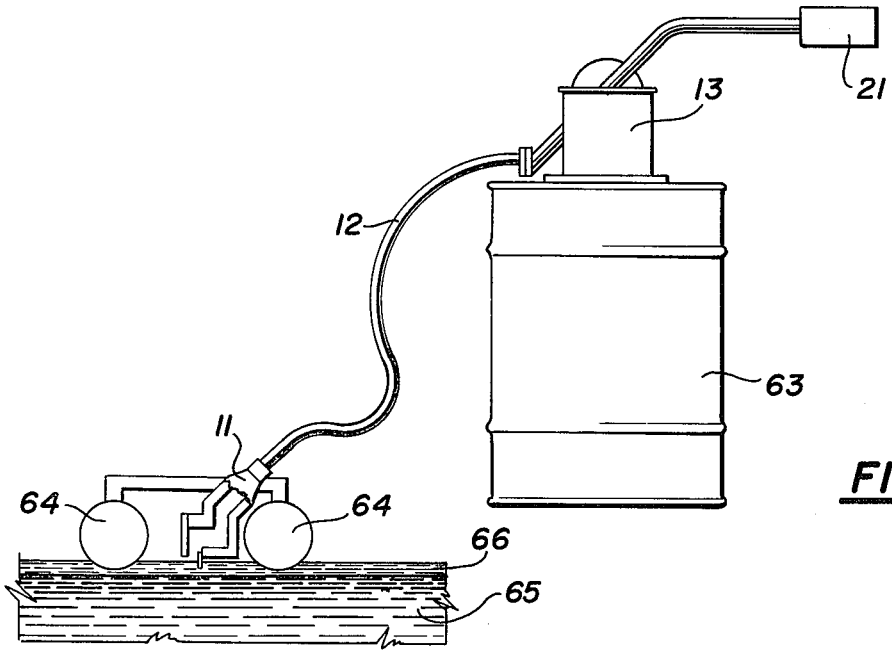
FIG. 6 is an elevational view of the present separation system in operation.

FIG. 6 shows the present separator system arranged to pick up oil spills on bodies of water without deterioration of the oil. To begin with, because this type of job will normally involve substantial quantities of liquid, the flat plate shown as the bottom 29 of the outer chamber 18 is replaced by removing the flat plate and bolting the base flange 19 of the outer chamber 18 to an opening in the top of a standard container, such as the 55-gallon drum 63 shown in FIG. 6. The flexible hose 12 leads from the separator 13 to the pickup head 11. The pickup head 11 is provided with floats 64 which suspend the pickup head 11 in a proper position over a pool of water 65 having on its surface a layer of oil 66. With the floats 64 maintaining the pickup head 11 at the optimum relationship with respect to the oil and water, it is found that a mixture which is substantially all oil (depending on the thickness of the oil slick) is entrained in the gas stream passing through the pickup head 11 and up to the separator 13. In the separator 13 the liquid water and oil drop out of the gas stream and fall into the barrel 63. When the barrel becomes full, the separator can be transferred to a new barrel. The barrel is then allowed to settle and the water layer at the bottom of the barrel is drained off to leave a barrel of generally pure oil.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A separator system for picking up flow substance from a surface, comprising a. an exhaust means, b. an outer chamber having a top with a central opening connected to the exhaust means, having a side wall, and having a bottom, c. an inlet conduit having a first end which enters through the side wall of the outer chamber above a selected level, d. a pick-up head attached to the other end of the inlet conduit, and e. an inner chamber positioned within the upper portion of the outer chamber, the inner chamber having a tubular side wall surrounding the central opening and with an open bottom located below the said selected tubular level.

2. A separator system as recited in claim 1, wherein an outlet conduit is provided which enters the top of the inner chamber and which is connected to the exhaust source, and the side wall of the inner chamber and the outer chamber are cylinders.

3. A separator system as recited in claim 2, wherein the side walls of the inner and outer chambers are coaxial.

4. A separator system as recited in claim 2, wherein the inlet conduit forms an angle of approximately 45° with the generatrix of the side wall of the outer chamber.

5. A separator system as recited in claim 2, wherein the inlet conduit has an axis and the outer chamber has an axis and the axes are coplanar.

6. A separator system as recited in claim 1, wherein bottom of the outer chamber is removable from the side wall.

7. A separator system as recited in claim 6, wherein the bottom of the outer chamber is a barrel.

8. A separator system as recited in claim 1, wherein a check spout is provided on the side wall of the outer chamber, the check spout being adapted to be closed when liquid level inside the outer chamber is below it and open when liquid level inside the outer chamber is above it.

9. A separator system as recited in claim 1, wherein a vacuum breaker is provided which admits air to the inner chamber when the liquid level within the outer chamber reaches the said level, but does not admit air when the liquid level is below the said level.

10. A separator system as recited in claim 1, wherein the chambers are provided with a controlled leak.

11. A separator system as recited in claim 1, wherein the tops of the inner and outer chambers are a single element.

* * * * *